US011085467B2

(12) United States Patent
Meignat et al.

(10) Patent No.: US 11,085,467 B2
(45) Date of Patent: Aug. 10, 2021

(54) HYDRAULIC ACTUATORS

(71) Applicant: Goodrich Actuation Systems SAS, Saint Ouen-l'Aumône (FR)

(72) Inventors: Gregory Y. Meignat, St Germain en Laye (FR); Arnauld R.E. Hervieux, Versailles (FR)

(73) Assignee: GOODRICH ACTUATION SYSTEMS SAS, Saint-Ouen-l'Aumône (FR)

( * ) Notice: Subject to any disclaimer, the term of this patent is extended or adjusted under 35 U.S.C. 154(b) by 0 days.

(21) Appl. No.: 17/075,945

(22) Filed: Oct. 21, 2020

(65) Prior Publication Data

US 2021/0156405 A1 May 27, 2021

(30) Foreign Application Priority Data

Nov. 22, 2019 (EP) ..... 19290114

(51) Int. Cl.
*F15B 15/22* (2006.01)

(52) U.S. Cl.
CPC ..... *F15B 15/225* (2013.01); *F15B 15/222* (2013.01); *F15B 15/223* (2013.01)

(58) Field of Classification Search
CPC ..... F15B 15/222; F15B 15/223; F15B 15/225
USPC ..... 91/406
See application file for complete search history.

(56) References Cited

U.S. PATENT DOCUMENTS 886,402 A * 5/1908 Pike ..... F15B 15/223 91/26
3,322,039 A * 5/1967 Madland ..... F15B 15/225 91/405
3,877,344 A 4/1975 Langland
4,397,218 A 8/1983 Spring
7,387,061 B2 * 6/2008 Kobata ..... F15B 15/222 60/461
2011/0107756 A1 5/2011 Kondo et al.
2014/0138890 A1 5/2014 Kawakami
2018/0222599 A1 8/2018 Papadopoulos et al.

FOREIGN PATENT DOCUMENTS

GB 1209088 10/1970
SE 308864 B 2/1969

OTHER PUBLICATIONS

European Search Report for Application No. 19290114.8, dated Mar. 23, 2020, 9 pages.

* cited by examiner

*Primary Examiner* — Michael Leslie
(74) *Attorney, Agent, or Firm* — Cantor Colburn LLP

(57) ABSTRACT

A hydraulic actuator includes a piston and a cylinder. The piston is axially movable within the cylinder. A stroke end damping valve is provided in a hydraulic fluid flow passage of the actuator and adjacent an end of the cylinder. The stroke end damping valve comprises a damping orifice and a valve element for selectively varying the area of the damping orifice and thereby changing the damping provided by the orifice. The valve element projects from a wall of the cylinder into the cylinder and is engageable by the piston as the piston moves towards the end of the cylinder. This reduces the area of the damping orifice and thereby increases the damping effect on the piston towards the end of its stroke in the cylinder.

18 Claims, 4 Drawing Sheets

HYDRAULIC ACTUATORS

FOREIGN PRIORITY

This application claims priority to European Patent Application No. 19290114.8 filed Nov. 22, 2019, the entire contents of which is incorporated herein by reference.

TECHNICAL FIELD

The present disclosure relates to hydraulic actuators, and in particular to preventing bottoming of an actuator piston in an actuator cylinder.

BACKGROUND

Hydraulic actuators are used in a wide range of applications. One such application is in the actuation of flight control surfaces in an aircraft. Such surfaces may include for example primary control surfaces such as rudders or secondary control surfaces such as slats, flaps or air brakes.

When the actuator is unpressurised, for example after operation or when an aircraft is parked, forces may be exerted on the actuator by the control surface due to, for example wind gusts. The actuator piston may then move in the actuator cylinder and in an extreme condition may engage the end of the piston cylinder. This "bottoming out" may, if unchecked, occur at high speed and may cause damage to the actuator.

To avoid this problem, it has been proposed to incorporate a mode valve in hydraulic actuators which, when the actuator is unpressurised, selectively connects the chambers on opposed sides of the piston with each other through a damping orifice. While effective, this may be quite complicated.

SUMMARY

From a first aspect, the disclosure provides a hydraulic actuator comprising a piston and a cylinder. The piston is axially movable within the cylinder. A stroke end damping valve is provided in a hydraulic fluid flow passage of the actuator. The valve is arranged adjacent an end of the cylinder. The stroke end damping valve comprises a damping orifice and a valve element for selectively varying the area of the damping orifice and thereby changing the damping provided by the orifice. The valve element projects from a wall of the cylinder into the cylinder and is engageable by the piston as the piston moves towards the end of the cylinder. This reduces the area of the damping orifice and thereby increases the damping effect on the piston towards the end of its stroke in the cylinder.

The wall of the cylinder from which the valve element projects may be a side wall of the cylinder in certain embodiments. In other embodiments, it may be an end wall of the cylinder.

The stroke end damping valve may be configured and arranged so as to be operative in only the final 20% of the maximum stroke of the piston within the cylinder. In certain embodiments it may be operative in only the final 10% of the maximum stroke of the piston within the cylinder. In other embodiments, it may be operative in only the final 5% of the maximum stroke of the piston within the cylinder. In yet further embodiments, it may be operative in only the final 2% of the maximum stroke of the piston within the cylinder, The valve element may be a ball in certain embodiments. In other embodiments, it may be a needle.

The valve element may be spring biased into the cylinder.

The valve element may be retained in the wall of the cylinder by a retainer. In certain embodiments, the retainer may comprise an element mounted in the wall of the cylinder.

The piston may comprise a radially recessed axial end portion for engaging the damping valve element.

The radially recessed axial end portion of the piston may have a constant diameter along its length in certain embodiments. In other embodiments, the radially recessed axial end portion of the piston may increase in diameter along its length in the direction away from the end of the piston.

A respective stroke end damping valve may be provided at respective ends of the cylinder to provide damping in respect of movement of the piston in either direction towards the end of its stroke in either direction within the cylinder.

The disclosure also provides a method of preventing damage to a hydraulic actuator. The method comprises selectively increasing the damping of a piston as it moves towards an end of a cylinder by selectively reducing the size of a damping orifice formed in a hydraulic fluid flow path of the actuator as the piston moves towards the end of its stroke within the cylinder.

The method may comprise selectively reducing the size of the damping orifice by means of a valve element which is engaged by the piston as it moves towards the end of its stroke in the cylinder.

The method may comprise selectively increasing the damping on the piston in both its directions of movement within the cylinder.

Damping may be provided in only the operative in only the final 20% of the maximum stroke of the piston within the cylinder. In certain embodiments it may be provided in only the final 10% of the maximum stroke of the piston within the cylinder. In other embodiments, it may be provided in only the final 5% of the maximum stroke of the piston within the cylinder. In yet further embodiments, it may be provided in only the final 2% of the maximum stroke of the piston within the cylinder.

BRIEF DESCRIPTION OF DRAWINGS

An embodiment of the disclosure will now be described by way of example only with reference to the accompanying drawings in which.

DETAILED DESCRIPTION

Figure 1:
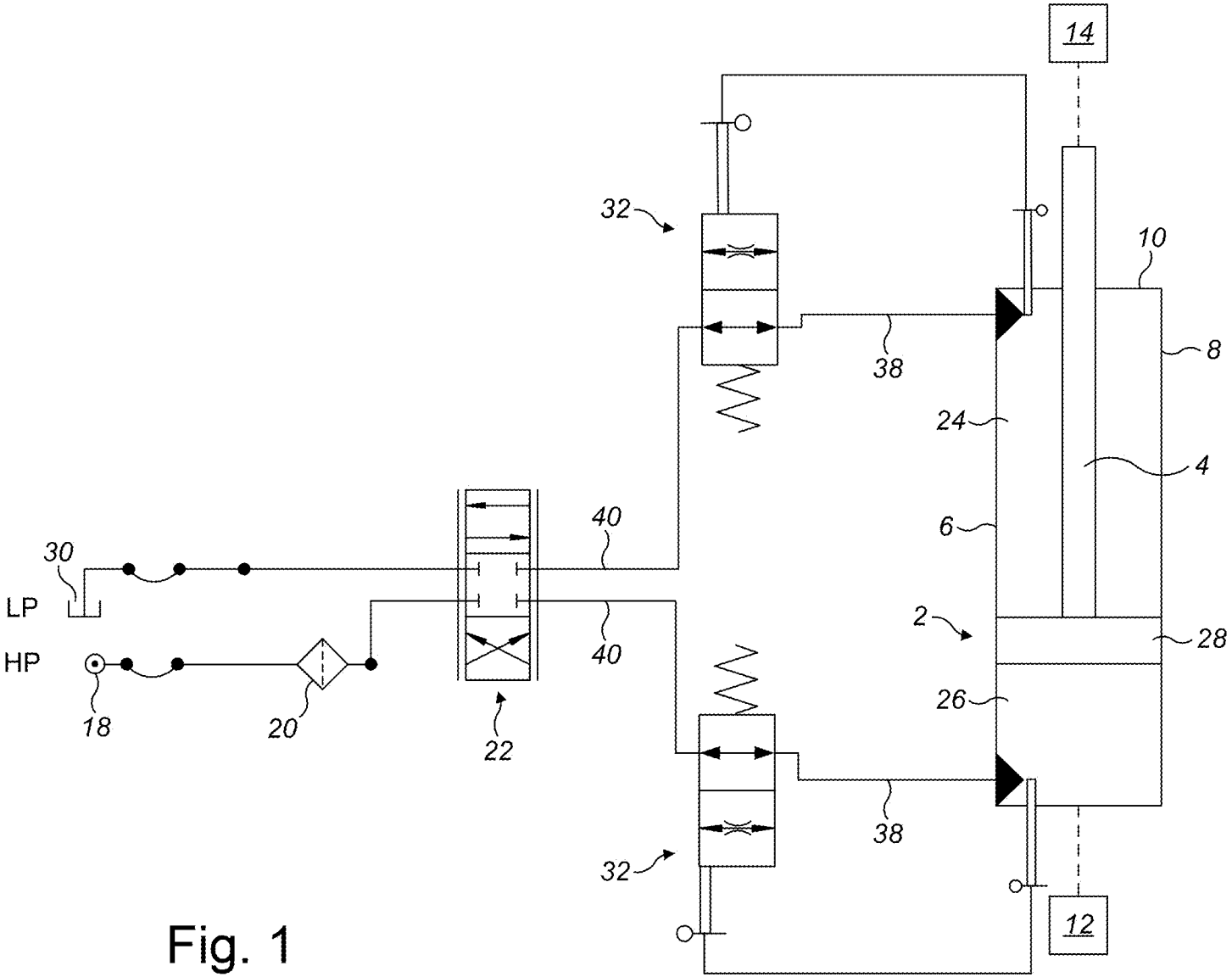
FIG. 1 illustrates schematically a hydraulic actuator in accordance with the disclosure.
Figure 2:
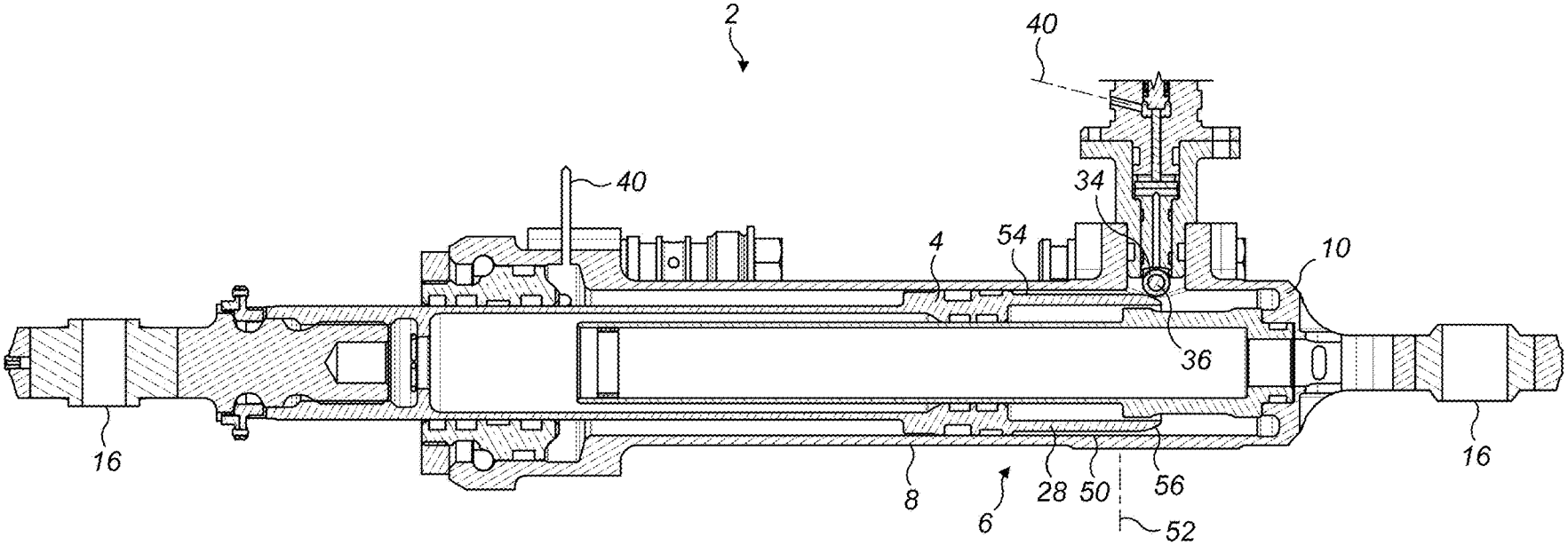
FIGS. 2 and 2*a* show the damping valve arrangement of FIG. 1 in more detail.

Referring to FIGS. 1 and 2, a hydraulic actuator 2 in accordance with the disclosure is illustrated.

The actuator comprises a piston 4 arranged for axial movement within a cylinder 6 having a side wall 8 and end walls 10. The piston 4 is received over a balance rod 11 which assists in locating the piston 4 in the cylinder 6. The balance rod 11 may house a position sensor in some embodiments. In various embodiments, the balance rod 11 may be omitted. The cylinder 6 and the piston 4 are attached respectively to a static structure 12 and a movable structure 14 by couplings 16 (FIG. 2) as is known in the art. The static structure may be a fixed structure in an aircraft, for example a wing structure and the movable structure may be a control or flight surface such as a rudder, slat or flap for example, again as known in the art.

Hydraulic fluid is supplied to the cylinder 6 from a high pressure source 18 of hydraulic fluid. Typically the fluid passes through a filter 20 and then into a valve 22 which directs the hydraulic fluid selectively to chambers 24, 26 in the cylinder 6 on either side of the piston head 28. As pressurised fluid enters one chamber 24, 26, the piston 4 moves, with the fluid exhausted from the other chamber 24, 26 being returned to a hydraulic fluid reservoir 30. Normally, the piston 4 will reciprocate within the cylinder 6 through a nominal stroke in which at one extreme position the piston head 28 is spaced a nominal distance from the adjacent end wall 10.

In the condition shown in FIG. 1, the valve 22 is in a closed position, whereby no fluid is supplied under pressure to the actuator 2. Thus the fluid in the actuator 2 is unpressurised and an input to the actuator 2 from the movable structure 14 may move the piston 4 in a direction towards the adjacent end wall 10. If unchecked, this could result in the piston head 28 engaging the end wall 10 at speed and with some force which could cause damage to the actuator 2.

To prevent or mitigate this problem, the actuator 2 is provide with a stroke end damping valve 32 which damps the movement of the piston 4 as it moves towards the end of its stroke within the cylinder 6. Details of the stroke end damping valve 32 can be seen in FIGS. 2 and 3.

The stroke end damping valve 32 comprises a damping orifice 34 which is selectively opened and closed by a valve element 36. In this embodiment, the valve element 36 is a ball, although other forms of valve element 36 may be used such as a pin or needle.

The damping orifice 34 is formed at an outlet 38 of the flow passage 40 which conducts hydraulic fluid to and from the chambers 24, 26 of the cylinder 6 and is formed as an annular space between a valve body 42 and the damping valve element 36. As the valve element 36 moves towards and away from the outlet 38, the size of the damping orifice 34 and thus its damping effect will change. The shape of the valve body 42 and valve element 36 may be tailored to provide the desired damping effect, for example a linear increase in damping as the valve element 36 moves towards the outlet 38, or some other damping effect. The initial size of the damping orifice 34 may be such that it does not produce a significant damping effect on flow of hydraulic fluid into and out of the chambers 24, 26 during normal operation of the actuator 2.

The damping valve element 36 is retained in a damping valve chamber 44 by means of a retainer 46 arranged in the side wall 8 of the cylinder 6. For example, the retainer 46 could be an integral part of the side wall 8 or a separate element mounted thereto.

The retainer 46 should be provided with openings to allow flow of hydraulic fluid into and out of the chamber 24, 26 during normal operation of the actuator 2. The retainer 46 may be an annular retainer. It may, for example comprise a plurality of circumferentially spaced radial arms 47 which retain the valve element 36. Of course other suitable forms of retainer 46 will be apparent to the skilled person.

Figure 3:
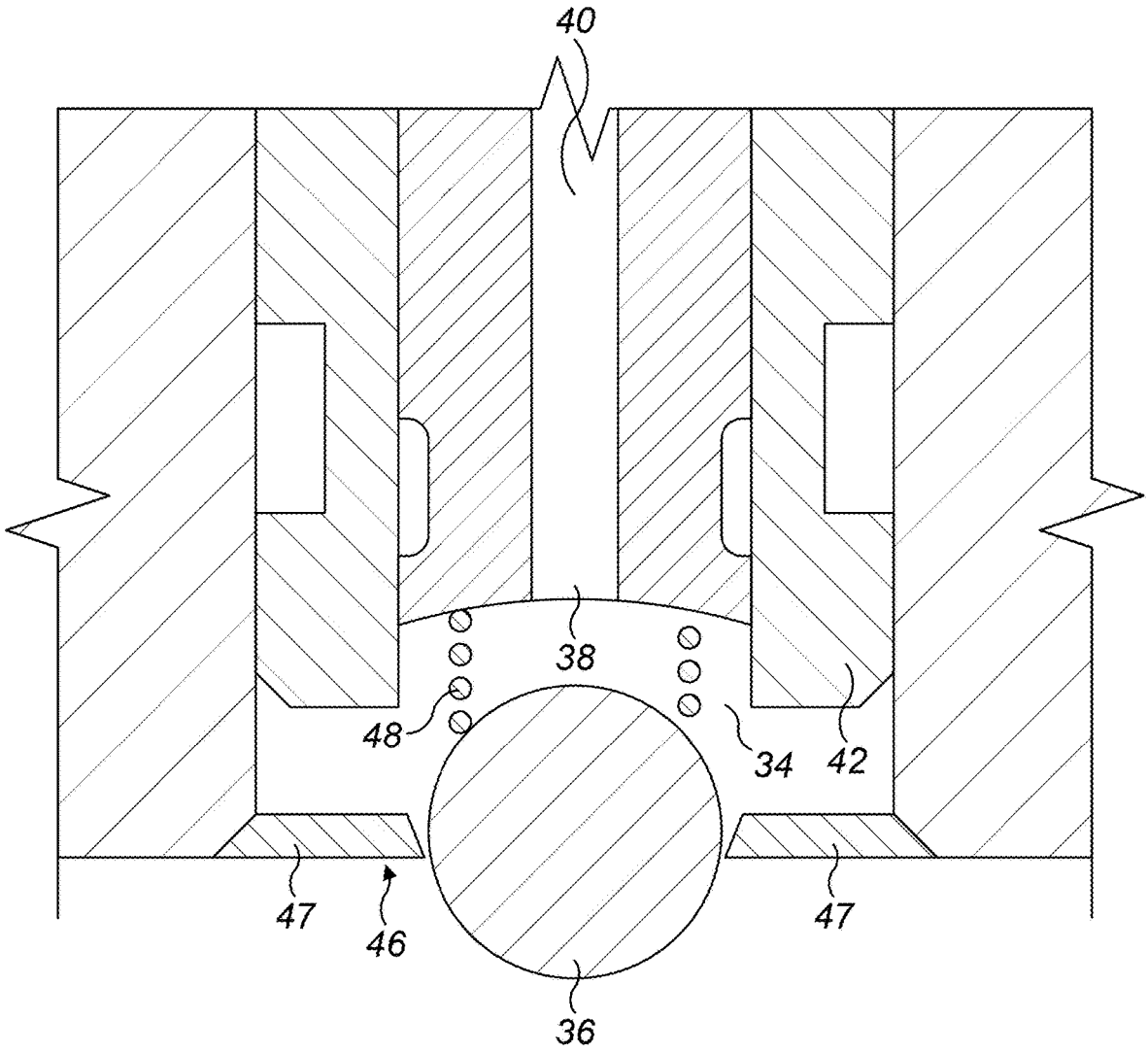
FIG. 3 shows a detail of the damping valve of FIG. 2.

The damping valve element 36 and retainer 46 are configured such that when the damping valve element 36 is seated on the retainer 46, the damping valve element 36 projects into the cylinder 6, as can be seen from FIGS. 2 and 3. The damping valve element 36 is biased towards the retainer 46. In this embodiment, the biasing is effected by a spring 48, for example a coil spring 48, arranged in the damping valve chamber 44. The spring 48 should have a sufficient spring force such that the damping valve element 36 is not deflected under the force of hydraulic fluid acting thereon during normal operation of the actuator 2, or is deflected insufficiently to provide significant damping.

As can be seen from FIG. 2, the valve element 36 projects sufficiently far into the cylinder 6 such that it radially overlaps an outer diameter 50 of the piston head 28. Accordingly, should the piston head 28 move axially beyond its normal stroke, for example beyond a predetermined position 52 in the cylinder 6, the piston head 28 will deflect the damping valve element 36 into the damping valve chamber 44 against the force of the biasing spring 48. This will change the area of the damping orifice 34.

Figure 2A:
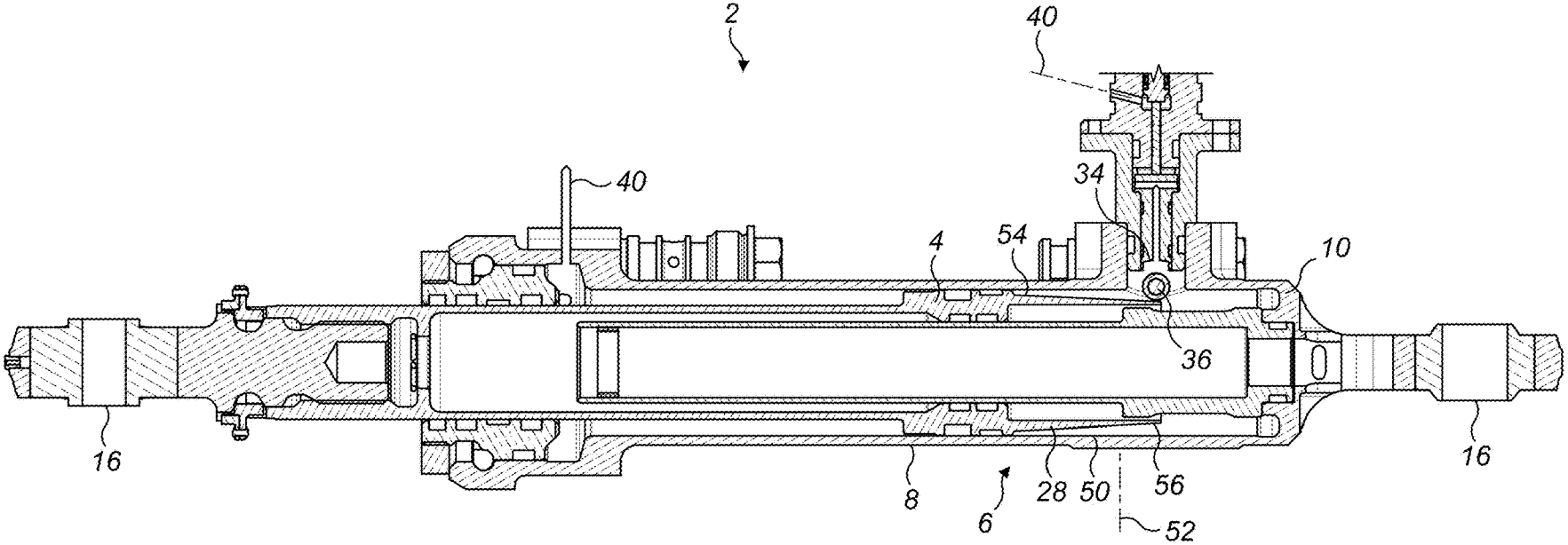

The axial end region 54 of the piston head 28 may, as shown, be recessed from the cylinder wall 8 to allow flow of hydraulic fluid through the damping valve 32 once the piston head 28 has moved axially beyond the damping valve 32. In the disclosed embodiment, the axial end region 54 is generally cylindrical, but other profiles may be adopted for reasons which will be discussed further below. The axial end 56 of the piston head 28 may be chamfered, rounded or otherwise profiled to facilitate engagement with the valve element 36. In one embodiment, the axial end portion 56 of the piston may increase in diameter along its length in the direction away from the end of the piston as shown in FIG. 2*a*.

The damping valve 32 may be positioned to provide a damping effect over a desired proportion of the maximum piston stroke within the cylinder. For example, in some embodiments, the damping valve 32 may be operative in only the final 20%, for example the final 10%, for example the final 5%, for example the final 2% of the maximum piston stroke. Thus the valve element 36 may be arranged such that it is deflected by the piston head in only the final 20%, for example 10%, for example in the final 5%, for example in the final 2% of the maximum piston stroke. The precise figure may be chosen to provide appropriate damping for any particular application.

Operation of the actuator 2 will now be described.

During normal powered operation, the actuator 2 will reciprocate under supply of hydraulic fluid to the chambers 24, 26 on either side of the piston head 28 through the flow passage 40. Normally during this reciprocating movement, the piston head 28 will not approach the end walls 10 of the cylinder 6, and the piston head 28 will not engage the damping valve element 36. When unpowered however, the piston 4 may be moved under forces applied by the structure 14 to which it is attached. As explained above, this may for example be due to wind gusts acting on an aircraft surface powered by the actuator 2. This may cause the piston head 28 to move beyond its normal end point of travel 52 in the cylinder 6 and so engage the damping valve element 36. As discussed above, the axial end 56 of the piston head 28 may be chamfered or rounded to facilitate the initial engagement of the piston head 28 with the valve element 36.

As the valve head 28 moves further towards the end wall 8 of the cylinder 6, the valve element 36 will be deflected into the damping valve chamber 44, thereby moving the valve element 36 towards the flow outlet 38 and thereby reducing the size of the damping orifice 34, thereby providing damping the movement of the piston 4. The degree of damping will be determined by the distance the valve element 36 moves towards the outlet 38 and by the shape of the valve element 36 and valve body 42.

As mentioned above, in the illustrated embodiment the end portion 54 of the piston head 28 is cylindrical, meaning that the damping effect will be constant as the piston 4 moves towards the end wall 8. However, it may be desirable to increase the damping effect as the piston head 28 approaches the end wall 8, in which case the end portion 54 of the piston head 28 may flare outwardly in the direction away from the end of the piston 4 so as to increase deflection of the valve element 36 as the piston 4 moves closer to the end wall 10.

With damping as described above, the likelihood of the piston head 28 striking the end wall 10 of the cylinder 6 is reduced, or if the piston head 28 does strike the end wall 10 it will do so with much less force, resulting in less likelihood of damage. The kinetic energy of the piston 4 will be dissipated by the flow of hydraulic fluid through damping valve 32.

The damping effect can be calibrated by the geometry of the damping valve parts and the geometry of the piston head 28.

While the damping valve 32 is particularly advantageous when the actuator 2 is unpowered, it will be appreciated that the damping valve 32 will also be effective in damping the movement of the piston 4 towards the cylinder end wall 10 during powered operation, thereby potentially avoiding a high energy impact of the piston 4 on the cylinder end wall 10.

A damping valve 32 may be provided at either end of the cylinder 6 to provide protection against high energy impact of the piston 4 in either direction of movement within the cylinder 6.

While the actuator 2 has been described in the context of powering aircraft surfaces, it may find application in other hydraulic systems to prevent impact of a piston 4 with a cylinder 6.

The damping arrangement of the disclosure is advantageous in that it avoids the need for an additional mode valve, as used in the prior art, thereby considerably simplifying the construction of the actuator 2.

It will be understood that modifications may be made to the particular embodiment discussed above without departing from the scope of the disclosure. For example, while the valve element 36 has been illustrated as projecting from the side wall 8 of the cylinder 6, in other embodiments, it may project from the end wall 10 of the cylinder 6.

The invention claimed is:

1. A hydraulic actuator comprising:

a piston;

a cylinder, the piston being axially movable within the cylinder; and a stroke end damping valve provided in a hydraulic fluid flow passage of the actuator and adjacent an end of the cylinder, the stroke end damping valve comprising:

a damping orifice; and a valve element for selectively varying the area of the damping orifice and thereby changing the damping provided by the orifice, wherein the valve element projects from a wall of the cylinder into the cylinder and is engageable by the piston as the piston moves towards the end of the cylinder to reduce the area of the damping orifice and thereby increase the damping effect on the piston towards the end of its stroke in the cylinder, and the wall of the cylinder is a side wall of the cylinder.

2. A hydraulic actuator as claimed in claim 1, wherein the stroke end damping valve is arranged so as to be operative in only a final 20% of the maximum stroke of the piston within the cylinder.

3. A hydraulic actuator as claimed in claim 1, wherein the stroke end damping valve is arranged so as to be operative in only a final 10% of the maximum stroke of the piston within the cylinder.

4. A hydraulic cylinder as claimed in claim 1, wherein the stroke end damping valve is arranged so as to be operative in only a final 5% of the maximum stroke of the piston within the cylinder.

5. A hydraulic cylinder as claimed in claim 1, wherein the stroke end damping valve is arranged so as to be operative in only a final 2% of the maximum stroke of the piston within the cylinder.

6. A hydraulic actuator as claimed in claim 1, wherein the valve element is a ball.

7. A hydraulic actuator as claimed in claim 1, wherein the valve element is spring biased into the cylinder.

8. A hydraulic actuator as claimed in claim 1, wherein the valve element is retained in the wall of the cylinder by a retainer.

9. A hydraulic actuator as claimed in claim 8, wherein the retainer comprises an element mounted in the wall of the cylinder.

10. A hydraulic actuator as claimed in claim 1, wherein the piston comprises a radially recessed axial end portion for engaging the damping valve element.

11. A hydraulic actuator as claimed in claim 10, wherein the radially recessed axial end portion of the piston has a constant diameter along its length.

12. A hydraulic cylinder as claimed in claim 10, wherein the radially recessed axial end portion of the piston increases in diameter along its length in the direction away from the end of the piston.

13. A hydraulic actuator as claimed in claim 1, further comprising:

a respective stroke end damping valve provided adjacent respective ends of the cylinder to provide damping in respect of movement of the piston in either direction towards the end of its stroke in either direction within the cylinder.

14. A method of preventing damage to a hydraulic actuator, the method comprising:

selectively increasing the damping of a piston as it moves towards an end of a cylinder by selectively reducing the size of a damping orifice formed in a hydraulic fluid flow path of the actuator as the piston moves towards the end of its stroke within the cylinder and the damping orifice is in a side wall of the cylinder.

15. A method as claimed in claim 14, further comprising:

selectively reducing the size of the damping orifice by means of a valve element which is engaged by the piston as it moves towards the end of its stroke in the cylinder.

16. A method as claimed in claim 15, further comprising:

selectively increasing the damping on the piston in both its directions of movement within the cylinder.

17. A method as claimed in claim 14, wherein damping is provided in only a final 20% of the stroke of the piston within the cylinder.

18. A method as claimed in claim 14, wherein damping is provided in only a final 10% of the stroke of the piston within the cylinder.

* * * * *